US010034086B2

(12) United States Patent
Sapiejewski et al.

(10) Patent No.: US 10,034,086 B2
(45) Date of Patent: Jul. 24, 2018

(54) HEADSET PORTING

(71) Applicant: Bose Corporation, Framingham, MA (US)

(72) Inventors: Roman Sapiejewski, Boston, MA (US); Mark Bergeron, Grafton, MA (US); Mihir D. Shetye, Framingham, MA (US)

(73) Assignee: Bose Corporation, Framingham, MA (US)

( * ) Notice: Subject to any disclaimer, the term of this patent is extended or adjusted under 35 U.S.C. 154(b) by 656 days.

(21) Appl. No.: 14/215,629

(22) Filed: Mar. 17, 2014

(65) Prior Publication Data

US 2014/0294222 A1 Oct. 2, 2014

Related U.S. Application Data

(63) Continuation-in-part of application No. 13/851,035, filed on Mar. 26, 2013.

(51) Int. Cl.
*H04R 3/02* (2006.01)
*H04R 1/10* (2006.01)

(52) U.S. Cl.
CPC ..... *H04R 3/02* (2013.01); *H04R 1/1083* (2013.01)

(58) Field of Classification Search
CPC ..... H04R 1/10; H04R 1/1008; H04R 1/1058; H04R 1/1066; H04R 1/1083; H04R 2460/01; G10K 11/16; G10K 11/162; G10K 11/172; G10K 11/175; G10K 11/178; G10K 11/18; G10K 11/36; G10K 2210/1081; G10K 2210/3214; G10K 2210/3219
USPC ..... 381/370–372
See application file for complete search history.

(56) References Cited

U.S. PATENT DOCUMENTS

| | | | | |
|---|---|---|---|---|
| 1,807,225 A | | 5/1931 | Pack | |
| 2,379,891 A | | 7/1945 | Eckardt | |
| 2,427,844 A | | 9/1947 | Eklov | |
| 3,073,411 A | | 1/1963 | Bleazey et al. | |
| RE26,030 E | | 5/1966 | Marchand et al. | |
| 4,160,135 A | * | 7/1979 | Gorike | H04R 1/2834 381/372 |
| 4,399,334 A | | 8/1983 | Kakiuchi et al. | |
| 4,455,675 A | | 6/1984 | Bose et al. | |
| 4,581,496 A | | 4/1986 | Sweany | |
| 4,644,581 A | | 2/1987 | Sapiejewski | |
| 4,922,542 A | | 5/1990 | Sapiejewski | |

(Continued)

FOREIGN PATENT DOCUMENTS

| | | |
|---|---|---|
| EP | 0195641 A2 | 9/1986 |
| GB | 2187361 A | 9/1987 |

(Continued)

*Primary Examiner* — Davetta W Goins
*Assistant Examiner* — Jasmine Pritchard

(57) ABSTRACT

A headset includes at least one ear cup having front and rear cavities separated by a driver. The cup includes a pressure equalization port coupling the front cavity to space outside the cup, the pressure equalization port having a cross-sectional area greater than 2 $mm^2$ and being significantly longer than it is wide, providing a principally reactive acoustic impedance, such that the pressure response of the front cavity including the port to signals input via the driver may be effectively linear over a wide range of pressure levels within the front cavity.

15 Claims, 6 Drawing Sheets

(56) References Cited

U.S. PATENT DOCUMENTS

| | | | | |
|---|---|---|---|---|
| 8,670,586 | B1 * | 3/2014 | Boyle | H04R 1/1008 381/189 |
| 2009/0161885 | A1 * | 6/2009 | Donaldson | G10K 11/1788 381/71.6 |
| 2010/0080400 | A1 * | 4/2010 | Sibbald | H04R 3/002 381/71.6 |
| 2013/0343593 | A1 * | 12/2013 | Howes | H04R 1/1016 381/380 |
| 2014/0211976 | A1 * | 7/2014 | Brunner | H04R 1/1066 381/374 |

FOREIGN PATENT DOCUMENTS

| | | | |
|---|---|---|---|
| GB | 2188210 | A | 9/1987 |
| NL | 8101815 | A | 11/1981 |

* cited by examiner

HEADSET PORTING

PRIORITY CLAIM

This application is a continuation-in-part of and claims priority to U.S. patent application Ser. No. 13/851,035, filed Mar. 26, 2013, the entire contents of which are incorporated herein by reference.

BACKGROUND

The present invention relates in general to headset porting and more particularly concerns headsets with linearized pressure equalization ports characterized by an acoustic impedance with a very low resistive component.

For background reference is made to U.S. Pat. Nos. 4,644,581, 5,181,252, and 6,831,984, incorporated herein by reference, including their file histories.

SUMMARY

In general, in one aspect, a headset includes at least one ear cup having front and rear cavities separated by a driver. The cup includes a pressure equalization port coupling the front cavity to space outside the cup, the pressure equalization port having a cross-sectional area greater than 2 $mm^2$ and being significantly longer than it is wide, providing a principally reactive acoustic impedance, such that the pressure response of the front cavity including the port may be effectively linear over a wide range of pressure levels within the front cavity.

Implementations may include one or more of the following, in any combination. The range of pressure levels within the front cavity may include sound pressure levels between about 120 dB SPL and 150 dB SPL. The pressure equalization port may include a tube longer than about 15 mm long. The pressure equalization port may include a tube having a cross-sectional area larger than about 1.75 $mm^2$. The pressure equalization port may include a tube having a length-to-inside diameter aspect ratio between about 10:1 and 25:1. The pressure equalization port tube may be made of metal. The metal may include stainless steel. The pressure equalization port tube may include a metal tube seated inside the wall of the front cavity. The cup may be made of plastic, and the pressure equalization port tube may be heat-staked to the plastic. An active noise reduction circuit may be coupled to the driver.

In general, in one aspect, a headset includes at least one ear cup having a front cavity and rear cavity with front cavity and rear cavity compliances respectively, and a high compliance driver between the front and rear cavities with a driver compliance that is greater than the rear cavity compliance. The ear cup includes a mass port and a resistive port connected to the rear cavity in parallel and a pressure equalization port connected to the front cavity, the pressure equalization port having a cross-sectional area greater than 1.75 $mm^2$ and being significantly longer than it may be wide, providing a principally reactive acoustic impedance, such that the pressure response of the front cavity including the port to signals input via the driver may be effectively linear over a wide range of pressure levels within the front cavity. An active noise reduction system is coupled to the driver.

In general, in one aspect, an apparatus includes a first ear cup shell of a headphone, a second ear cup shell of the headphone, an electroacoustic driver disposed between the first and second ear cup shells, such that the first ear cup shell and a first face of the driver define a front cavity, and the second ear cup shell and a second face of the driver define a rear cavity, and a metal tube at least 15 mm in length and having an internal bore with cross sectional area of at least 1.75 $mm^2$, the metal tube seated in the first ear cup shell and coupling the front cavity to space around the apparatus.

Other features, objects and advantages will become apparent from the following description when read in connection with the accompanying drawing in which:

DETAILED DESCRIPTION

Figure 1:
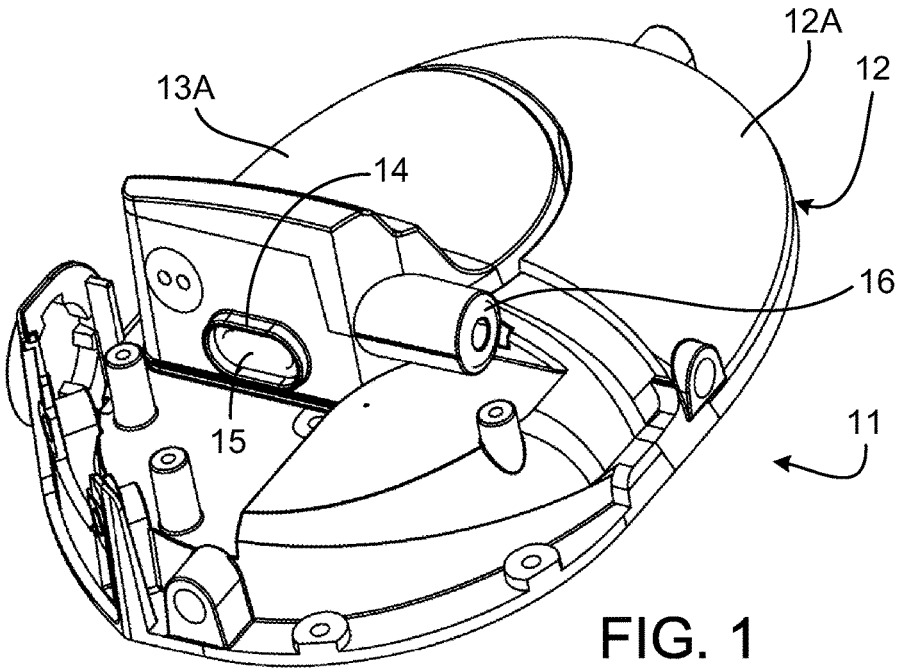
FIG. 1 is a perspective view of a headphone cup with a linearized port.
Figure 2:
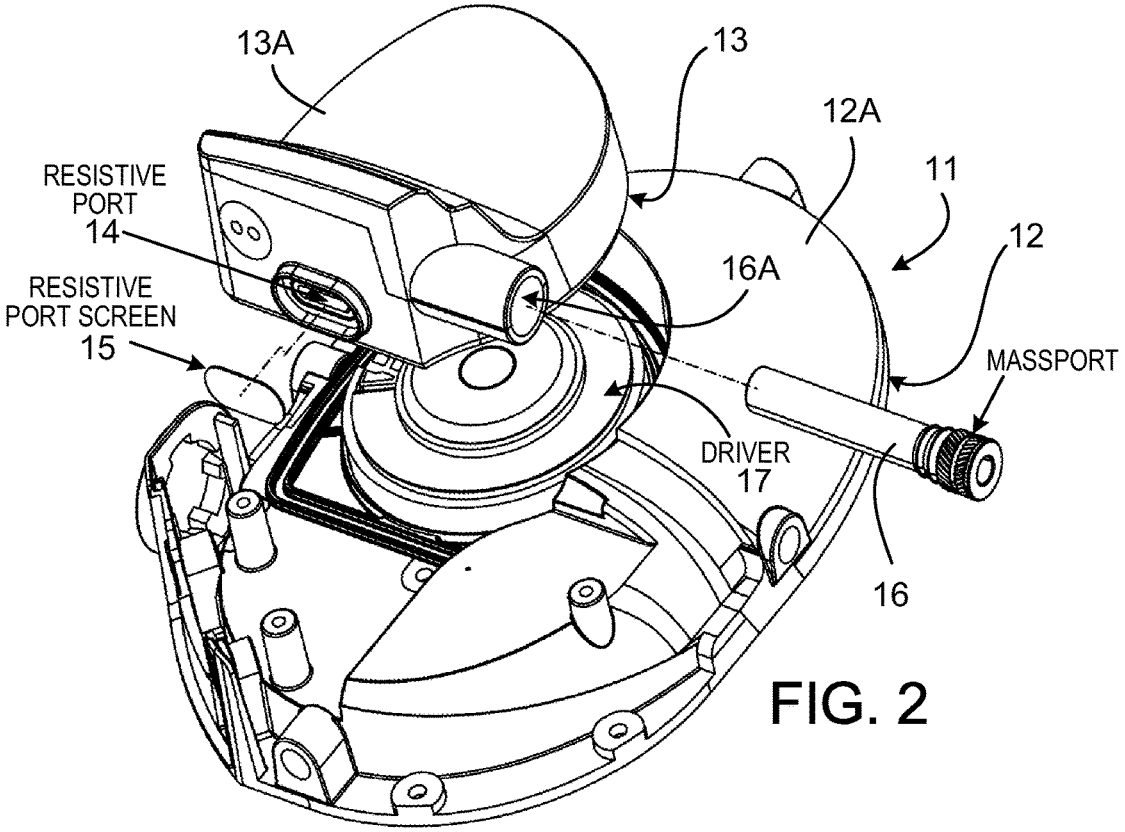
FIG. 2 is a partially exploded view of the headphone cup of FIG. 1 showing the relationship of the port to the headphone cup.

With reference now to the drawing and more particularly FIGS. 1 and 2 thereof, there is shown a perspective view of a headset cup embodying the invention. To avoid obscuring the principles of the invention, most conventional components of the headset, including portions of the cup, are not described in detail. Headset cup 11 includes a front cavity 12 partially enclosed by a shell 12A and a rear cavity 13 partially enclosed by a second shell 13A. The two cavities are separated by an electroacoustic transducer, or driver, 17. The front cavity couples sound output by the driver to the user's ear. Air enclosed by the rear cavity presents a controlled acoustic impedance to motion of the driver, controlling the response of the driver and the acoustic performance of the headset. Rear cavity 13 is coupled to the air around it by a resistive port 14 having a resistive port screen 15 and a mass port tube 16.

Both ports present an impedance to air flow that has a resistive and a reactive component. The resistive port 14 is of negligible length, so that the impedance of the port is dominated by the resistance of the port screen. The mass port 16 is significantly longer than it is wide, such that its impedance is dominated by its reactance, which depends on the acoustic mass of the volume of air inside the tube. The impedance of the mass port 16 varies with the frequency of the sound pressure in the rear cavity 13 that is causing air flow through them. In particular, as frequencies decrease, the contribution to total impedance from the reactive component of the mass port decreases, allowing the impedance to be dominated by the resistive component of the mass port's impedance at lower frequencies, which is relatively constant with frequency. The resistive component, however, varies with the sound pressure level inside the cavity, and this variable impedance results in the response being non-linear with pressure at frequencies where the resistive component dominates.

Figure 7:
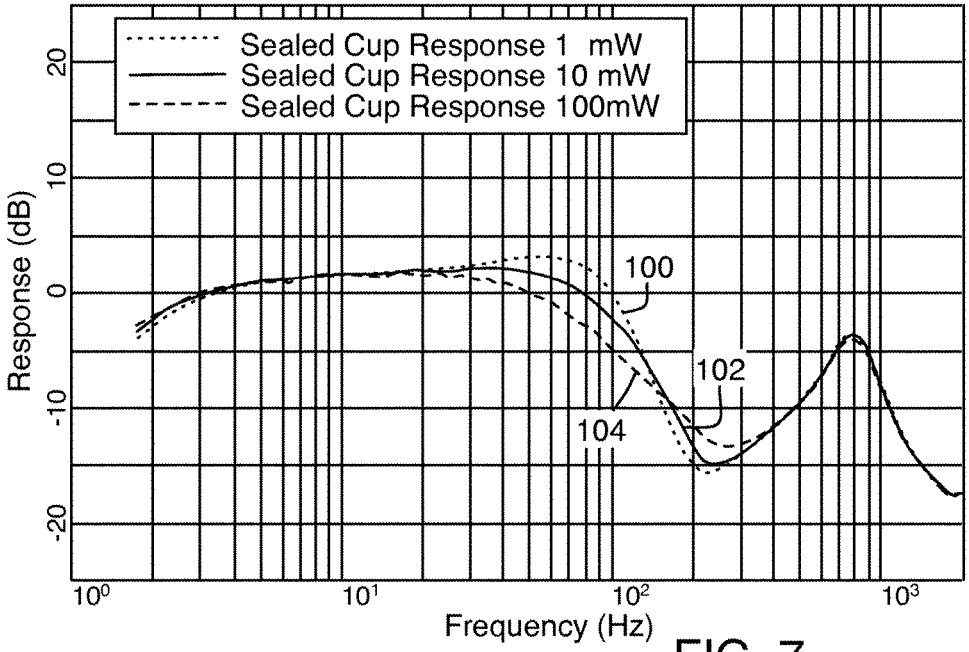
FIGS. 7, 8, 13, and 14 are graphs of headphone cup response to various power level inputs.

Non-linearity, i.e., impedance increasing with sound pressure levels, in the response of the acoustic system limits the output levels at which an ANR circuit can be operated—higher impedance requires more force to move the air, which requires more current through the motor of the transducer, potentially exceeding the capacity of the transducer or amplifier. FIG. 7 shows the normalized response of an ear cup using conventional ports to various input power levels, but with the resistive port (corresponding to 14 in FIG. 1) blocked, so only the mass port is operative. A first, dotted, line 100 shows the response when 1 mW of power is applied. As power is increased to 10 mW, in solid line 102, and 100 mW, in dashed line 104, it can be seen that the response between about 30 Hz and 150 Hz decreases with increasing power. In the particular headphone tested, with the front cavity sealed against a flat plate (not a human ear) these power levels delivered 122 to 137 dB SPL output levels at 60 Hz. Actual power delivered by the complete product would be significantly lower, as these tests were made without any compression used (as discussed below) to avoid overloading the driver. To achieve higher SPL levels in this frequency range, significantly more power would be needed. To avoid overloading the transducer, however, the maximum output power of the ANR circuit is limited, e.g., through compression or clipping, limiting the level of sound that the ANR circuit can cancel. In conventional ANR headsets, the non-linearity is not of significance at the pressure levels experienced in normal operation, so the limiting of output power will not be noticed by most users. Headsets for military applications, however, may be subjected to significantly higher sound pressure levels, at which point the non-linearity of the port response becomes a problem. Prior military ANR headsets have been limited to cancelling sound pressure levels of about 120 dB SPL to avoid compressing the signal.

Figure 8:
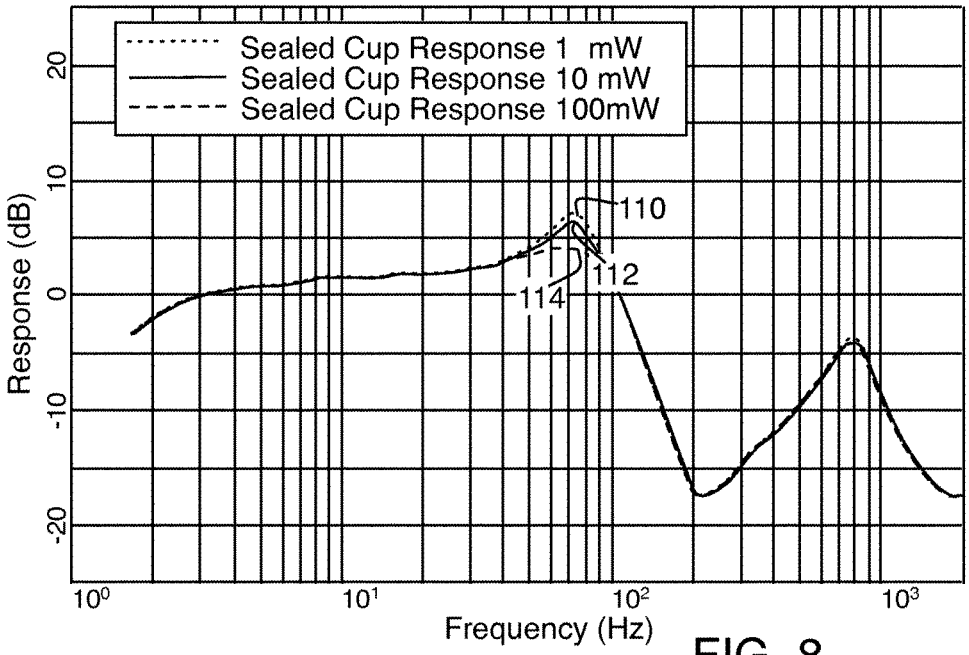

To address this problem, the mass port is modified, relative to prior designs, to decrease the resistive component of its impedance, extending the frequency range in which the reactive portion dominates and in which the total impedance as a function of frequency is essentially linear. The resistance is decreased by increasing the diameter of the mass port 16. Increasing the diameter alone decreases the effective acoustic mass of the port, so to maintain the original reactance, the length of the mass port is also increased. Increasing the length has more effect on the acoustic mass than it does on the resistance, so this does not undermine the benefits of increasing the diameter. In one example, the cross-sectional area of the port tube is increased from 2.25 $mm^2$ in conventional headsets to 9.1 $mm^2$. To maintain the reactance, the length is increased from 10 mm to 37 mm (end-effects result in the effective length being slightly longer, an effect which increases with diameter). That is, a 4× increase in area is matched by a 4× increase in length. FIG. 8 shows the response, in the same test as FIG. 7, with the enlarged mass port. Dotted line 110 shows the response to 1 mW of power, solid line 112 shows the response to 10 mW, and dashed line 114 shows the response to 100 mW. As can be seen, the response is much more linear—less variation with power levels—across the frequency range, only falling off with power by a small amount, and in a narrower range of 50 to 90 Hz. These normalized curves correspond to an SPL range of 125 dB to 143 dB at the 70 Hz peak. In a real application (resistive port open, leaky seal of front cavity to human head), the ANR circuit of the headset can operate effectively at sound pressure levels as high as 135 dB SPL at frequencies between around 60 to 100 Hz. In contrast, a prior art design embodied in the Bose® TriPort® Tactical Headset would clip the ANR output at sound pressure levels well below 120 dB SPL in the same frequency range to avoid overloading the circuit. Increasing the port dimensions also improves the consistency of the acoustic response across the audible frequency range.

The resistive port 14 in parallel to the mass port 16 also provides a resistive impedance, and it is desirable that the two impedances, resistive and reactive, remain parallel, rather than in series. The purely resistive port improves performance at some frequencies (where a back cavity with only a purely reactive port would have port resonance, significantly cutting output power), while compromising performance at others. Providing this resistance in a controlled, purely resistive port while the reactive port has as little resistance as possible allows that compromise to be managed and its benefits realized to the best advantage of the total system.

Thus, the performance of a headset for use in high-noise environments is improved by extending the operating frequency range at which the acoustic impedance of a mass port from the back cavity to ambient as a function of frequency is purely reactive, such that the total back cavity response remains effectively linear with respect to sound pressure levels. This is accomplished by increasing both the diameter and length of the port, but actually manufacturing such a port presents additional difficulty. As noted, the port in the example is 37 mm long, and has a cross-sectional area of 9.1 $mm^2$, or a diameter of 3.4 mm, for a roughly 10× aspect ratio of length to diameter. Another way to consider the size of the mass port is that the volume of air inside the tube is 337 $mm^3$, while the volume of the rear cavity (not including the volume occupied by the tube itself) is 11,100 $mm^3$, giving a ratio of rear cavity volume to mass port volume of about 33:1. A conventional mass port would have a significantly smaller volume, and thus a significantly larger ratio of rear cavity volume to mass port volume. For example, for the conventional mass port described above with an area of 2.25 $mm^2$ and a length of 10 mm, the volume is 22.5 $mm^3$, and the ratio, in the same size rear cavity, is 493:1. Applying a ten percent tolerance to port volume and cavity volume, the ratio of the present design may vary from around 27:1 to 40:1, while the ratio using the prior port size may vary from around 400:1 to 600:1. The applicant has also found that it is preferable for the port to be of uniform cross-section, to provide consistency in response from unit to unit. It is also preferable for the port to be smooth inside, to avoid causing turbulence, which could reintroduce a resistive component to the response. Providing a long, skinny tube of uniform cross-section and free of internal projections can be prohibitively difficult in the ABS plastic conventionally used for forming the shells 12A and 13A of the headset. Molding a tube with such a long draw could not be done with uniform cross section, and assembling a port from multiple pieces would introduce rough edges, as well as potential assembly variation.

To resolve this, in the embodiment shown in FIGS. 1-5, the mass port 16 is made of metal, such as stainless steel, and has a bore of uniform cross section throughout its length, preserving the reactive nature of the port response. Additionally, the metal port provides a smooth inside surface free of projections that would introduce turbulence, so keeping the resistive component of the port response low. In addition to delivering the desired port response, the metal mass port provides additional advantages. The high mass of the port tube itself prevents ringing of the tube structure (as opposed to the acoustic volume within the tube). For assembly, one end of the tube is formed with a rough surface such as knurling (FIGS. 2 and 4), allowing the metal tube to be heat staked into the ABS plastic of the outer shell 13A, providing a secure and reliable connection between the parts. The portion of the tube extending into the rear cavity may be kept smooth, to ease insertion and to avoid introducing turbulence inside the rear cavity. As can be seen in several of the figures, the tube 16 extends outside of the cavity 13 enclosed by the rear shell 13A. This decreases the amount by which the tube structure itself occupies the volume of the rear cavity, taking away volume available for air. In particular, the portion of the tube that is textured and secured to the plastic extends outside of the rear cavity.

The exploded view of FIG. 2 shows mass port tube 16 removed from the opening 16A that houses it in the back shell 13A. The back cavity shell 13A is also removed from the front shell 12A to reveal the driver 17.

Figure 3:
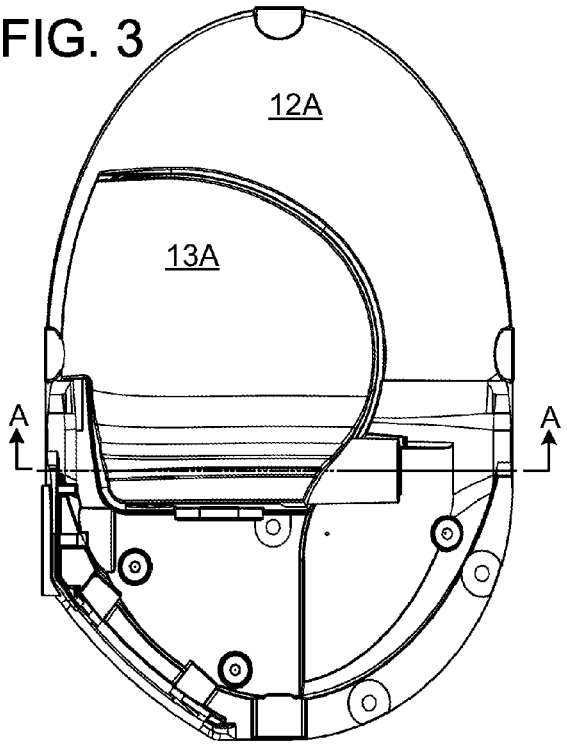
FIG. 3 is a plan view of the headphone cup of FIG. 1.

Referring to FIG. 3, there is shown a plan view of the headset cup of FIG. 1.

Figure 4:
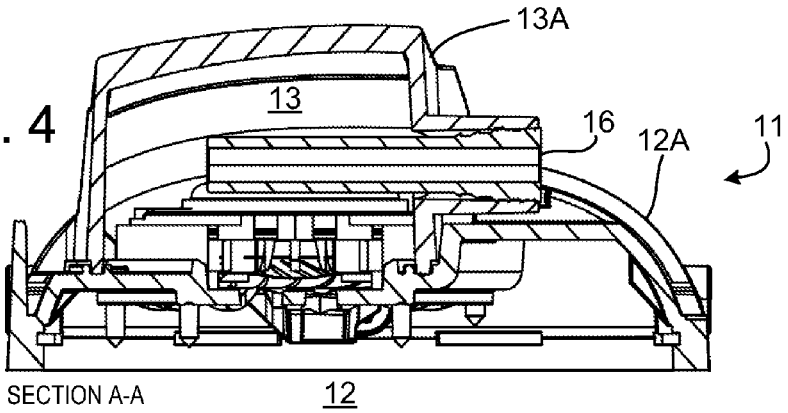
FIG. 4 is a sectional view of the headphone cup of FIG. 1 through section A-A of FIG. 3.

Referring to FIG. 4, there is shown a sectional view through section A-A of FIG. 3 showing the relationship of mass port tube 16 to rear cavity 13.

Figure 5:
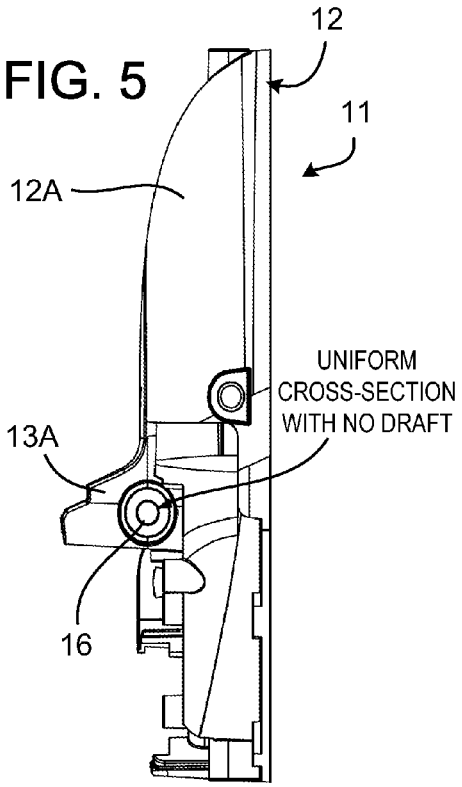
FIG. 5 is a side view of the headphone cup of FIG. 3.

Referring to FIG. 5, there is shown a side view of the headset cup of FIG. 1.

The headset of FIG. 1 typically comprises an active noise reducing headset incorporating circuitry of the type described in the aforesaid U.S. Pat. No. 6,831,984 and other patents described therein.

Figure 6:
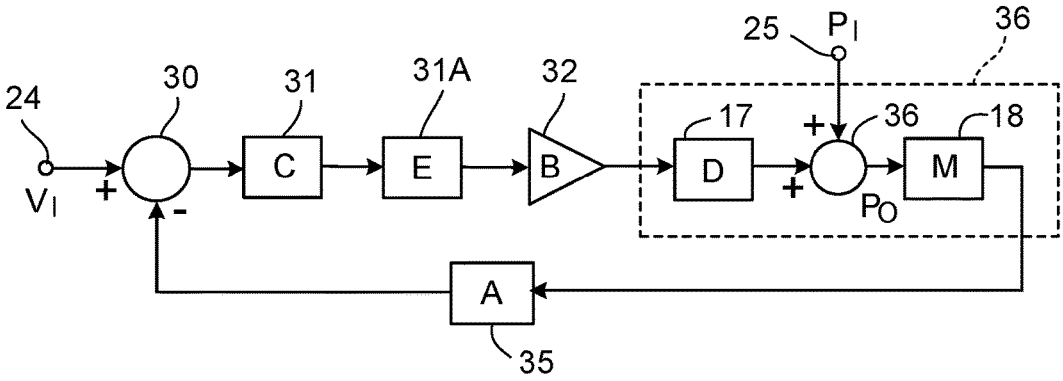
FIG. 6 is a block diagram illustrating the logical arrangement of an active noise reduction system embodying the invention.

Referring to FIG. 6, there is shown a block diagram illustrating the logical arrangement of a system incorporating the invention corresponding substantially to FIG. 1 of the aforesaid '581 patent and FIG. 4 of the aforesaid '252 patent. A signal combiner 30 algebraically combines the signal desired to be reproduced by the headphones, if any, on input terminal 24 with a feedback signal provided by microphone preamplifier 35. Signal combiner 30 provides the combined signal to compressor 31 which limits the level of the high level signals. The output of compressor 31 is applied to compensator 31A. Compensator 31A includes compensation circuits to insure that the open loop gain meets the Nyquist stability criteria, so that the system will not oscillate when the loop is closed. The system shown is duplicated once each for the left and right ears.

Power amplifier 32 amplifies the signal from compensator 31A and energizes headphone driver 17 to provide an acoustical signal in cavity 12 that is combined with an outside noise signal that enters cavity 12 from a region represented as acoustical input terminal 25 to produce a combined acoustic pressure signal in cavity 12 represented as a circle 36 to provide a combined acoustic pressure signal applied to and transduced by microphone 18. Microphone amplifier 35 amplifies the transduced signal and delivers it to signal combiner 30.

There has been described a ported headset characterized by a port having a linear acoustic impedance at high sound levels to allow improved noise reduction in a very noisy environment where the sound level may be greater than 120 dB SPL between 60 and 100 Hz. It is evident that those skilled in the art may now make numerous uses and modifications of and departures from the specific apparatus and techniques herein disclosed without departing from the inventive concepts. Consequently, the invention is to be construed as embracing each and every novel feature and novel combination of features present in or possessed by the apparatus and techniques herein disclosed and limited solely by the spirited scope of the appended claims.

As shown in FIGS. 9 through 14, another port in a noise reducing headset that benefits from linearization is a pressure equalization (PEQ) port. Unlike the ports discussed above, which primarily serve to control the acoustic response of the headset, the PEQ port is primarily intended to allow pressures inside the front cavity of the ear cup (caused, e.g., by an external force pressing on the ear cup) to equalize with pressures outside the ear cup. Putting a hole through the ear cup has the potential to undermine the noise cancellation properties of the headset, as the goal is to not transfer sound pressures outside the ear cup into the ear cup. This is normally balanced by making the PEQ port as small as possible, so that it equalizes pressure only at a low frequency, that is, it equalizes steady-state pressure differences, not SPL differences within the audible range.

Nevertheless, prior PEQ port designs still cause some reduction in noise reduction performance. In addition, a small PEQ port may also behave as if it were closed at high pressure, even for low frequencies. This can be improved by making the port larger in area, allowing more air flow at high pressure, but such a larger hole further compromises passive noise reduction. Making the PEQ port more reactive in the same manner discussed above for the mass port restores the passive attenuation lost by increasing the area of the port. Making the PEQ port longer increases its resistance as well as its reactance. This increased resistance is at least partially offset by the lowering of resistance caused by making the port area larger, so the net resistance increase is not large enough to undermine the improved linearity of the larger port.

Figure 9:
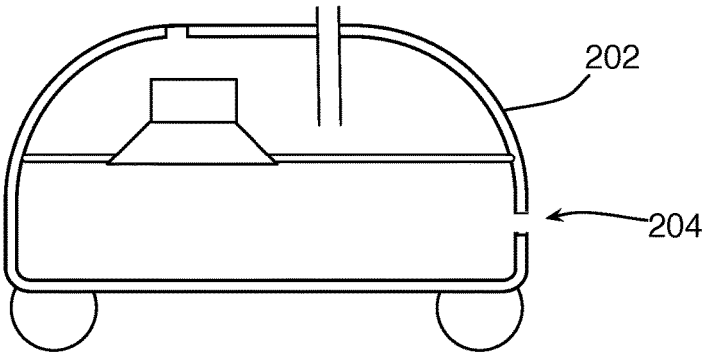
Fig. 9 (Prior Art)
FIGS. 9 and 10 are schematic cross-sectional views of a headphone cup with a linearized pressure equalization port.
Figure 10:
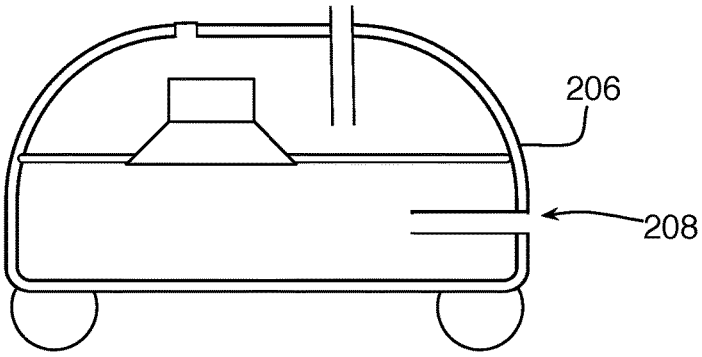

FIGS. 9 and 10 show, schematically, a prior art PEQ port and an improved PEQ port. In FIG. 9, the ear cup 202 includes a short, small-diameter PEQ port 204, essentially simply a hole through the plastic shell of the ear cup. In FIG. 10, the ear cup 206 has a longer, wider PEQ port 208, which takes the form of a tube extending into the ear cup front volume. In one particular example, the front volume of both ear cups is 100 $cm^3$, and the original PEQ port 204 is 1 mm in diameter by 1.5 mm long. The improved PEQ port 208 is 1.7 mm in diameter and 20 mm long. This represents about a 3× increase in effective area (0.78 $mm^2$ to 2.27 $mm^2$) and a 13.3× increase in length. At a minimum, it is preferred that the port be at least 1.75 $mm^2$ in effective cross-sectional area and at least 15 mm long. The ratio of the length to the diameter should be in the range of 10:1 to 25:1. The actual area may vary along the length of the tube, such as if a flare is provided at one or both ends. The effective area corresponds to the average area, or an area that might be determined by measuring the acoustic effects of the tube and assuming it is uniform.

Figure 11:
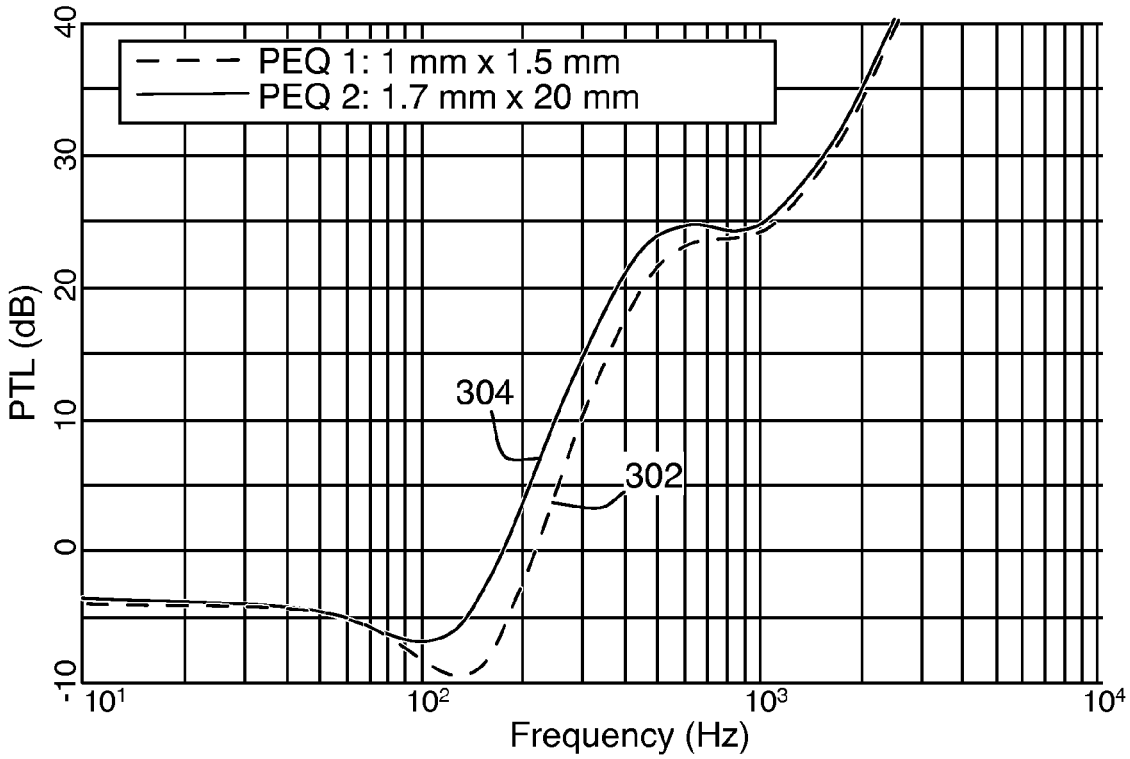
FIGS. 11 and 12 are graphs of headphone cup response with different pressure equalization port designs.
Figure 12:
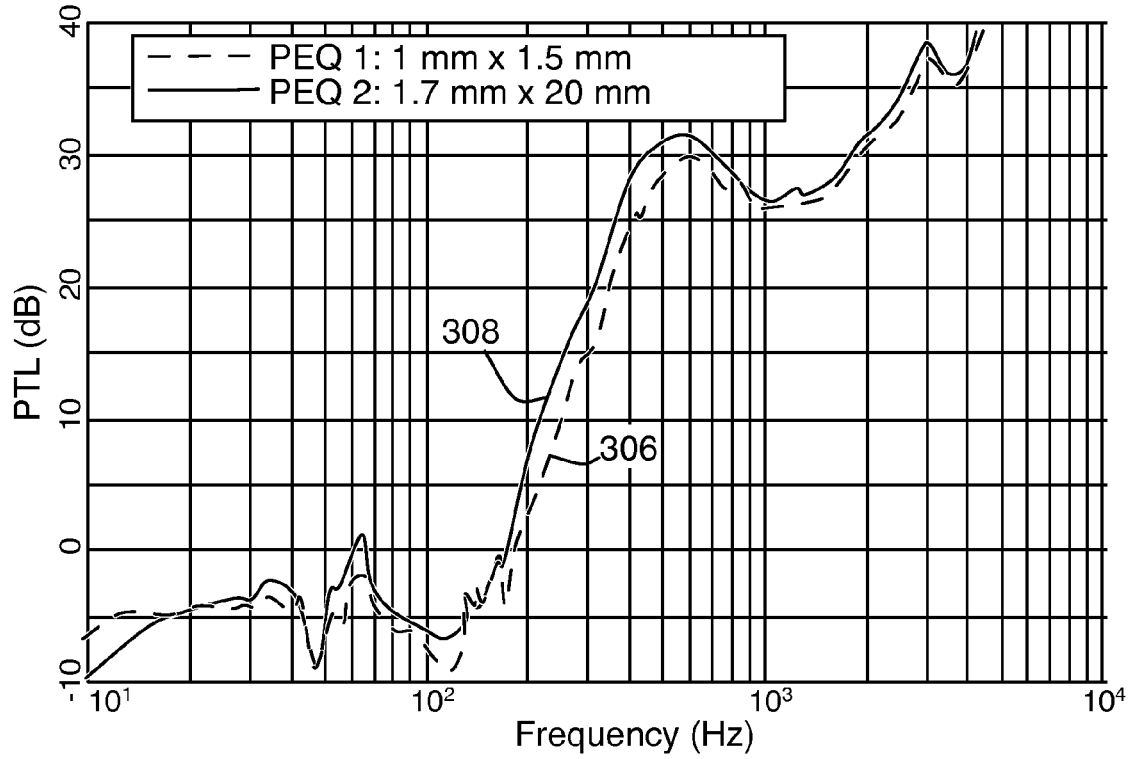

As with the mass port above, increasing the diameter of the PEQ port while making it longer maintains the resistive component of its acoustic impedance, while increasing its length maintains, and in this case increases, the reactive component. As shown in FIG. 11, which shows modeled behavior, the effect of this increase is to raise the passive transmission loss (PTL), that is, the passive attenuation of the ear cup, between 100 Hz and 700 Hz by about 2 dB. Curve 302 shows the PTL of the original design, and curve 304 shows the improved PTL of the new design. As shown in FIG. 12, which shows measurements on an actual headphone prototype, the PTL is noticeably improved from about 200 Hz to about 800 Hz. Curve 306 shows the actual performance of the prior PEQ port used in a prototype ear cup, and curve 308 shows the actual performance of the new PEQ port in the same prototype ear cup.

Although not audible directly, low-frequency pressure variations below 20 Hz, which may be caused by physical movement of the ear cup, can cause audible effects in an active noise reduction system, referred to as buffeting. Increasing the diameter of the PEQ port decreases the buffeting heard in an ANR headset by allowing the port to remain linear at higher pressure levels.

Figure 13:
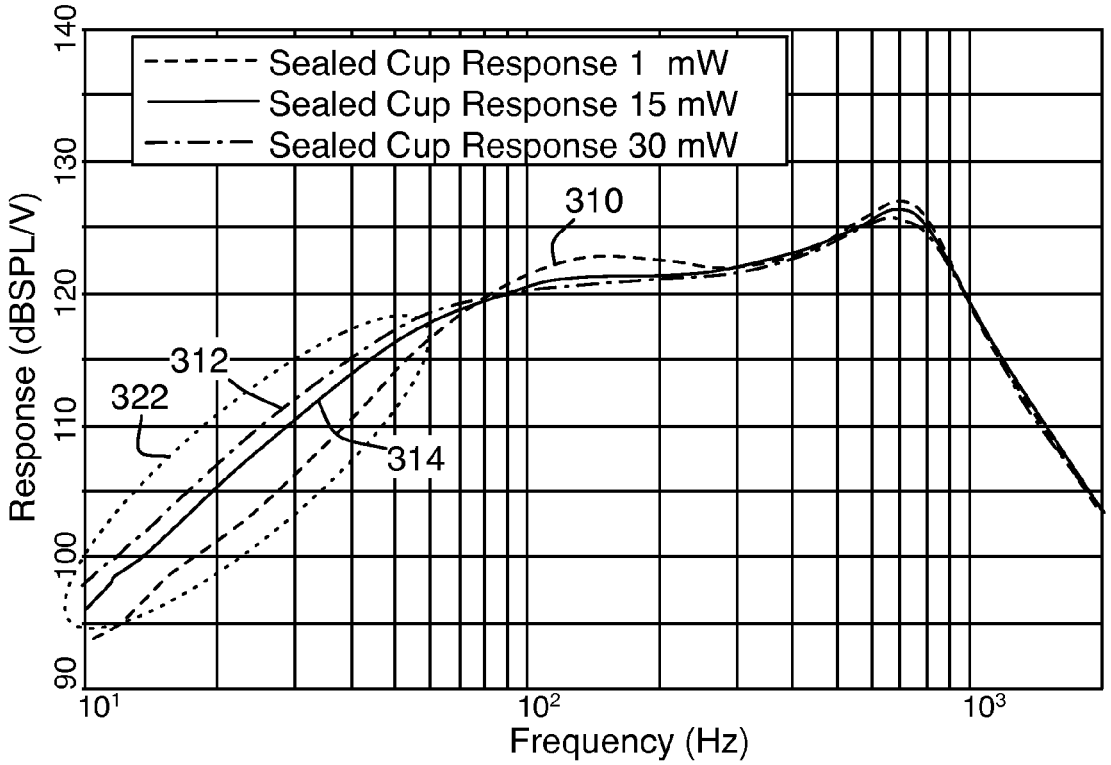
Figure 14:
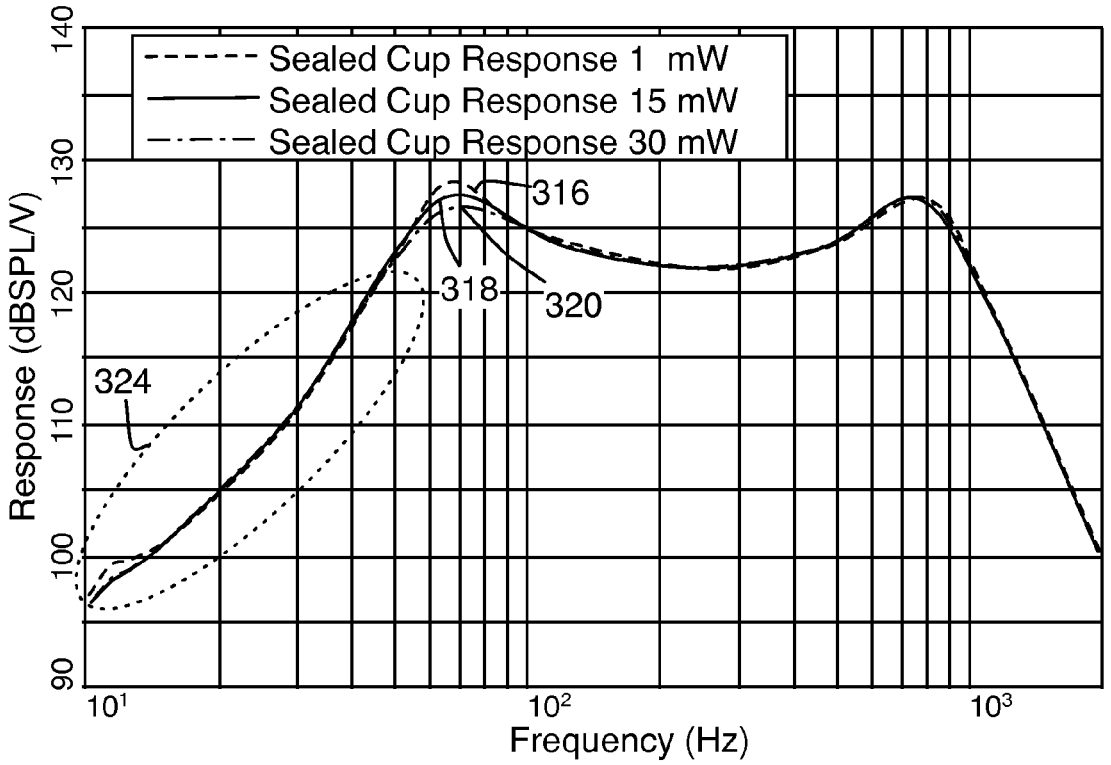

FIGS. 13 and 14 compare the pressure in the front ear cup, in response to differing input signal levels, in the prior art and improved designs, respectively. The different input signal levels correspond to different absolute pressure levels inside the ear cup, as higher signal levels cause the driver to produce higher pressures. Because the response is shown as dB SPL per Volt, the curves compare the shapes of the responses, not their absolute levels. In FIG. 13, significant variation in the shape of the response is seen for varying input signal levels, particularly at low frequencies, highlighted by dotted oval 322. Dashed line 310 shows the expected response at low input signal levels. For medium and higher signal levels, curves 312 and 314, the curves show that there is a higher pressure generated inside the ear cup. This higher pressure, as mentioned above, can cause problems with the ANR system. In FIG. 14, with the longer, wider port, there is very little variation in the shape of the response between the different input signal levels, curves 316, 318, and 320, especially at the low frequencies of interest, highlighted by dotted oval 324. This shows that regardless of input signal, the pressure in the ear cup is consistent ant the disturbance to the ANR system has been removed.

What is claimed is:

1. A headset comprising, at least one ear cup having a front cavity and rear cavity with front cavity and rear cavity compliances respectively, a high compliance driver between the front and rear cavities with a driver compliance that is greater than the rear cavity compliance, the ear cup comprising a mass port and a resistive port connected to the rear cavity in parallel and a pressure equalization port connected to the front cavity, the pressure equalization port having an effective cross-sectional area greater than 1.75 $mm^2$ and being significantly longer than it is wide, providing a principally reactive acoustic impedance, such that the pressure response of the front cavity including the port to signals input via the driver is effectively linear over a wide range of pressure levels within the front cavity, and an active noise reduction system coupled to the driver.

2. The headset of claim 1 wherein the pressure equalization port comprises a tube having a length-to-inside diameter aspect ratio between about 10:1 and 25:1.

3. The headset of claim 1, wherein the range of pressure levels within the front cavity comprise sound pressure levels between about 120 dB SPL and 150 dB SPL.

4. The headset of claim 1 wherein the pressure equalization port comprises a tube longer than about 15 mm long.

5. The headset of claim 1 wherein the pressure equalization port tube is made of metal.

6. The headset of claim 5 wherein the metal comprises stainless steel.

7. The headset of claim 5 wherein the pressure equalization port tube comprises a metal tube seated inside the wall of the front cavity.

8. The headset of claim 5 wherein the cup is made of plastic, and the pressure equalization port tube is heat staked to the plastic.

9. An apparatus comprising:

a first ear cup shell of a headphone, a second ear cup shell of the headphone, an electroacoustic driver disposed between the first and second ear cup shells, such that the first ear cup shell and a first face of the driver define a front cavity, and the second ear cup shell and a second face of the driver define a rear cavity, and a metal tube at least 15 mm in length and having an internal bore with an effective cross-sectional area of at least 1.75 $mm^2$, providing a principally reactive acoustic impedance, the metal tube seated in the first ear cup shell and coupling the front cavity to space around the apparatus.

10. The apparatus of claim 9, wherein the first ear cup shell comprises plastic, and the metal tube comprises a rough exterior surface at one end, the rough exterior surface being anchored in the plastic of the first ear cup shell.

11. The apparatus of claim 9, wherein the internal bore of the tube is generally uniform in cross-section.

12. The apparatus of claim 9, wherein the internal bore of the tube is generally smooth.

13. The apparatus of claim 9, wherein the metal tube is made of stainless steel.

14. The apparatus of claim 9, wherein the pressure equalization port comprises a tube having a length-to-inside diameter aspect ratio between about 10:1 and 25:1.

15. The apparatus of claim 9, further comprising an active noise reduction circuit coupled to the electroacoustic driver.

* * * * *